US005977522A

United States Patent [19]

Henrich et al.

[11] Patent Number: 5,977,522

[45] Date of Patent: Nov. 2, 1999

[54] MOUNTING DEVICE, FOR LIGHT GUIDES, OPERATING AS A COOKING ZONE MARKING WITH SLEEVE-LIKE RECEPTACLES

[75] Inventors: Thomas Henrich, Steinbach; Thomas Weingaertner, Gau-Algesheim; Juergen Meinl, Hohenstein-Holzhausen; Holger Koebrich, Floersheim; Stefan Hubert, Budenheim; Bernd Schultheis, Schwabenheim, all of Germany

[73] Assignee: Schott Glaswerke, Mainz, Germany

[21] Appl. No.: 08/984,687

[22] Filed: Dec. 3, 1997

[30] Foreign Application Priority Data

Dec. 13, 1996 [DE] Germany ..... 196 51 859

[51] Int. Cl.[6] ..... H05B 3/68

[52] U.S. Cl. ..... 219/445.1

[58] Field of Search ..... 219/464, 458, 219/463, 453, 465, 466, 467, 468

[56] References Cited

U.S. PATENT DOCUMENTS

| | | | |
|---|---|---|---|
| 5,013,893 | 5/1991 | Goessler et al. | 219/453 |
| 5,103,077 | 4/1992 | Goessler et al. | 219/453 |
| 5,448,036 | 9/1995 | Husslein et al. | 219/464 |
| 5,750,959 | 5/1998 | Plumptre | 269/465 |

*Primary Examiner*—Teresa Walberg
*Assistant Examiner*—Shawntina Fuqua
*Attorney, Agent, or Firm*—Michael J. Striker

[57] ABSTRACT

In order to provide a mounting device for light guides which is pre-mountable on a heating element or on a cooking surface and which can be equipped with the light guides in a simple way, several receptacles (20) for the light guide ends are arranged beside each other on a common receptacle support (1). The receptacle support (1) can itself be formed as an attaching element or can be provided with at least one attaching element. The receptacles are sleeves (24) under tension or crimped sockets in which the light guide ends are inserted and gripped under tension.

19 Claims, 11 Drawing Sheets

FIG.1b
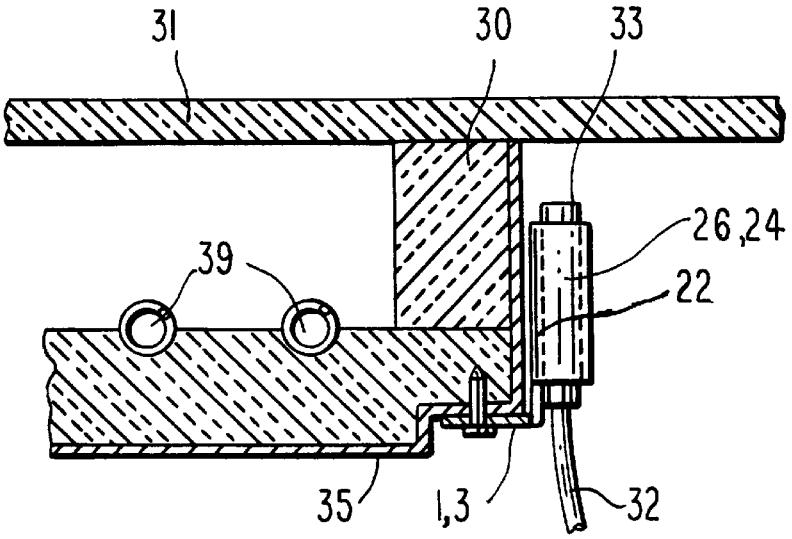
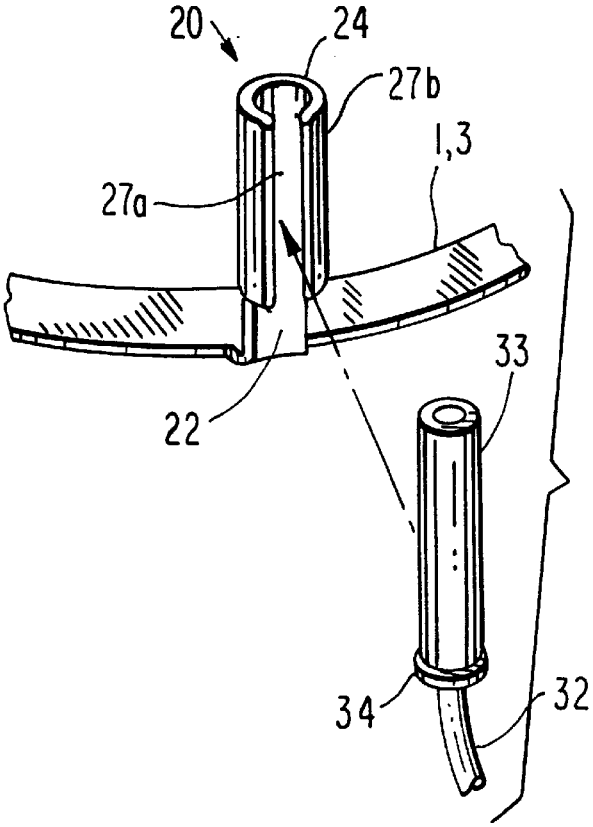
FIG.2

MOUNTING DEVICE, FOR LIGHT GUIDES, OPERATING AS A COOKING ZONE MARKING WITH SLEEVE-LIKE RECEPTACLES

BACKGROUND OF THE INVENTION

The present invention relates to a mounting device for light guides operating as a cooking zone marking and/or residual heat indicator.

Heat indicators or residual heat indicators are known in cooking apparatus with glass-ceramic cooking surfaces. These indicators signal the user whether the cooking zone is hot or already has been cooled sufficiently so that the user can touch the cooking zone without being burned.

German Patent Application DE 92 05 907 U1 describes a device of this type for indicating residual heat in an electric cooking plate. A holder with a pot-shaped light housing is attached by means of attaching arms to the heating element housing. One heating arm engages over an upper edge of the heating element housing and locks in there, while another arm engages under the base of the housing and engages in a hole found there.

Furthermore an apparatus for signaling information and operating condition of a heating apparatus is disclosed in German Patent Application DE 44 25 847 A1. A flat mounting adapter made from temperature-resistant plastic is glued to the underside of the glass-ceramic plate, whereby a dressing of the decor of the cooking surface occurs. The mounting adapter sets the position of the signaling element on the cooking surface upper side for decor, which only needs to be clipped into the mounting adapter. A mounting device is provided, which carries one or more lamps and which is provided with means for locking in the mounting adapter. Incandescent lamps are used as lighting devices, but there is no disclosure regarding their mounting means.

Besides this residual heat indicator illuminated cooking field boundaries are also known, in which a ring bounding the cooking field is primarily illuminated by means of a light source arranged under the cooking surface. The associated glass-ceramic plate is pressed until completely in this ring, so the internal light source is visible through the unpressed ring as a boundary. The required pressing of the glass-ceramic surface limits the freedom in developing newer ceramic designs.

In order to obtain a greater flexibility regarding heating surface boundaries, the use of a light guide system is suggested German Patent Application DE 44 05 610 A1. Several light guides extend from a single light source which end in several light output positions arranged in a circle in the vicinity of the heating field. The glass-ceramic plate is thus illuminated from below at several point-like spots. An attachment device for the light guide ends is however not disclosed.

SUMMARY OF THE INVENTION

It is an object of the present invention to provide a mounting device for light guides, which is mounted on a heating element or a cooking surface and can be equipped with light guides in a simple manner.

According to the invention, the mounting device for light guides operating as a cooking zone marking and/or residual heat indicator, comprises a receptacle support operating itself as a means for attaching or provided with at least one attaching element and a plurality of receptacles arranged beside each other on the receptacle support, each of the receptacles including means for receiving an end portion of a light guide. The receptacles each comprise a sleeve under pre-tension in which the end portion of one of the light guides is inserted or the receptacles each comprise a crimped socket in which the end portion of one of the light guides is inserted and gripped under tension.

The receptacle support is fit to the form and size of the respective cooking surface boundaries and can, e.g., have a circular, oval or rectangular form. The positions of the receptacles and thus of the light guides are determined by the form of the receptacle support. Also several mounting devices, which have respective pluralities of receptacles, can be combined for one cooking surface boundary. In this case the receptacle support can be, e.g., a circular segment.

When the receptacle support is itself a means for attaching, e.g. as a ring-shaped metal strip with holes for screws or the like, the receptacle support can, for example, be attached to the underside of the heating element housing and can be pre-attached in this way.

According to a second alternative attaching elements are provided on the receptacle support, e.g. in the form of attaching straps, which permit mounting either on the underside of the cooking surface or on the heating element housing.

The receptacle support can be attached on the retaining frame of the cooking surface, especially screwed on or locked with the retaining frame.

The receptacles are arranged on the receptacle support so that the long axis of the sleeves is oriented perpendicularly to the cooking surface after mounting of the mounting device. The sleeves provide the advantage that they are open on the top and bottom so that the light guide ends, which are held in a jacket, can be inserted from below and light can radiate upward without hindrance. Because the sleeve is under pre-tension, the light guide ends are gripped in it after insertion.

When the jackets of the light guide ends each have a collar, the light guide ends are pushed in the respective sleeves far enough so that the respective collars contact on the lower edges of the sleeves. This provides the advantage that the spacing of the light outlet surfaces of the light guide ends from the lower side of the glass-ceramic cooking surface can be fixed by the mounting device.

In order to simplify the insertion of the light guide ends, the sleeves can have a truncated cone shape, whereby the smaller diameter faces the cooking surface when the mounting device is attached.

The receptacle support is advantageously a metal strip on which the sleeves or crimped sockets are arranged as integral parts. By the choice of the material, e.g. steel sheet, the calculated high temperature load in the vicinity of the heating element (temperatures reaching up to 300° C. for a short time and from 200 to 250° C. for a comparatively longer time) can be carried.

The mounting device can be made in a simple way from a stamped part which only needs to be suitably curved. Preferably the sleeves or crimped sockets each comprise at least one rolled-up strap which expands on insertion of a light guide element.

The receptacles can also be stamped or punched from the receptacle support so that, for example, a strap is formed for each receptacle which is connected in one piece with the receptacle support and which is formed subsequently.

The receptacles can also be attached to the receptacle support by means of a point weld or hard solder.

Preferably the sleeves are directly connected with the receptacle support. Alternatively they are connected with the receptacle support via a retaining element.

When the receptacle support is not itself formed as an attaching element, preferably at least one attaching strap is provided on the receptacle support. The at least one attaching strap according to its attachment to the receptacle support serves for connecting it to the heating element housing or to the underside of the cooking surface. Additional attaching means, such as hooks or a mounting adapter, can be used, with which the at least one attaching strap cooperates.

The hooks preferably mounted on the receptacle support can engage over the edge of the heating element housing, i.e. the mounting device is suspended or hung on the heating element housing, while the at least one attaching strap is braced on the underside of the heating element housing. In this embodiment the attaching strap can have an upwardly pointed tip at its free end, which presses in a suitable opening of the heating element housing. These type of openings are already usually present in the base plate of the heating element housings presently on the market.

When the at least one attaching strap is provided for mounting on the underside of the cooking surface, an additional mounting means is preferably used, which is designated as a mounting adapter and is mounted on the underside of the glass-ceramic cooking surface. The at least one attaching strap can then be inserted or clipped in the mounting adapter.

In a preferred embodiment the mounting adapter has a U-shape and includes side members each provided with a slot for insertion of the attaching strap according to a preferred embodiment.

To be able to adjust the spacing of the light guide ends, the mounting adapter is provided with at least one suitable spacer on its upper surface.

Furthermore at least one spring element an be arranged on the attaching strap, which engages under the heating element housing and presses against the cooking surface. In this case the heating element housing at the same time is held from the mounting device.

The mounting adapter furthermore can have a sensor function. The mounting adapter preferably has an electrically insulated metal surface which operates as a pot detecting sensor.

Since a bundle of light guides are usually installed in the mounting device, holding straps are preferably attached to the receptacle support as a mounting aid.

BRIEF DESCRIPTION OF THE DRAWING

The objects, features and advantages of the invention will now be illustrated in more detail with the aid of the following description of the preferred embodiments, with reference to the accompanying figures in which:

FIG. 1*b* is cross-sectional view of the circular mounting device shown in FIG. 1*a* in a built-in state;

FIG. 2 is a perspective action view of a sleeve according to another embodiment;

DESCRIPTION OF THE PREFERRED EMBODIMENTS

Figure 1A:
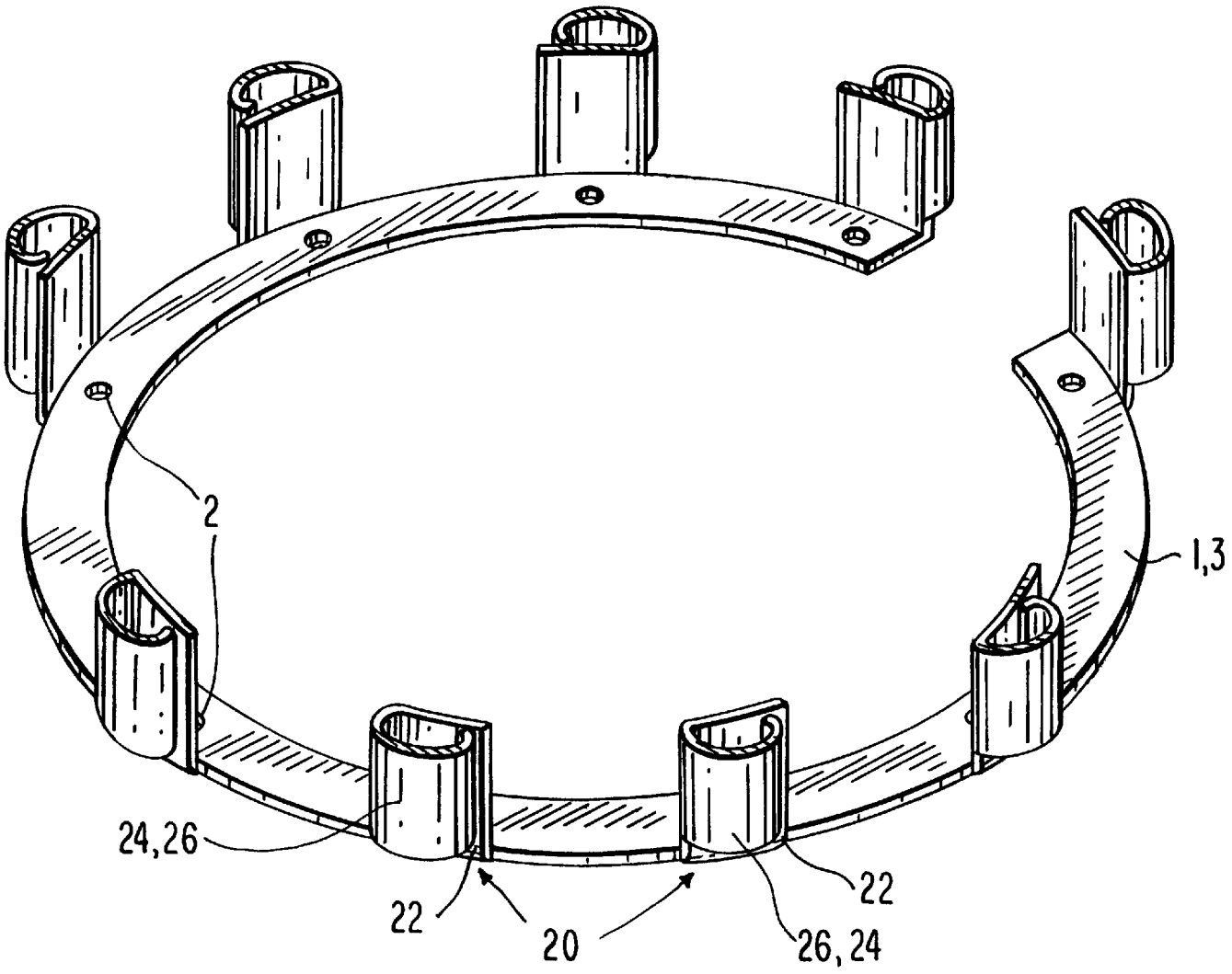
FIG. 1*a* is a perspective view of one embodiment of a circular mounting device according to the invention.

A mounting device according to the invention is shown in FIG. 1*a*. This mounting device comprises a circular receptacle support 1 in the form of a flat metal strip 3. This receptacle support 1 in this embodiment is formed as an attaching element and has a number of throughgoing holes 2 through it so that the receptacle support 1—as shown in FIG. 1*b*—can be screwed onto the underside of the heating element housing 35. Several receptacles 20 are arranged at a right angle equally spaced from each other along an outer edge of the receptacle support 1. Each receptacle 20 comprises a retaining element 22 in the form of an upright piece, on which a rolled-up strap 26 is arranged which forms a sleeve 24 in which a light guide can be inserted. This rolled-up strap 26 has a smaller diameter than that of the light guide and is under tension so that on insertion of the light guide—as shown in FIG. 1*b*—it is gripped there. The sleeve 24 can have a truncated cone-shaped form, whereby the larger diameter is located at its lower end.

The mounting means shown in FIG. 1*a* is illustrated in the built-in state in FIG. 1*b*. Insulating material 30 in which heating element 39 is embedded is placed in the heating element housing 35. The heating element compartment is covered on its upper side by a glass-ceramic plate 31. The receptacle support 1 is attached to the underside of the heating element housing 35 so that the receptacles 20 surround the heating element housing 35 in a ring-like arrangement. The ends of the light guides 32 point vertically upward because of the right-angled arrangement of the sleeves 24 so that the light outlet surfaces face the underside of the glass-ceramic plate 31. Since the individual light guide ends are gripped in a jacket 33, the diameter of the sleeve 24 is adjusted to the outer diameter of this jacket 33.

The spacing of the sleeves 24 is selected so that the electrical contact to the heating element can be located between two sleeves 24. The length of the sleeves 24 is thus dimensioned so that the light guide ends have about 0.5 to 1 mm spacing to the lower side of the glass-ceramic plate 31. Because of that, on the one hand, a direct contact to the glass-ceramic underside is avoided which is usually advantageous for the mechanical strength and, on the other hand, the spacing is kept as small as possible, so that an undesirable light interruption is largely prevented by the knobs (not shown) on the underside of the glass-ceramic plate.

The mounting device shown in FIGS. 1*a* and 1*b* is a punched or stamped part made from sheet metal, in which the receptacles are made by bending and rolling of the upright strip. This feature has the advantage that the metal strip can be made automatically from a sheet metal piece in comparatively large numbers. The stamping or punching, bending and lengthening occur in a sequential working process.

A different embodiment having a sleeve with a different form is shown in FIG. 2. The sleeves 24 are each connected by a retaining element 22 in the form of an upright bent strip to the receptacle support 1 and comprise two rolled-up straps 27*a* and 27*b*. Both rolled-in straps 27*a* and 27*b* are adjusted to the diameter of the jacket 33 of the light guide 32 and are under suitable tension. The jacket 33 has a collar 34. The length of the sleeve 24 is adjusted to fit the length of the jacket 33 so that the collar 34 can be moved into contact with the lower edge of the rolled-up straps 27*a* and 27*b*. The spacing of the light outlet surfaces of the light guide from the underside of the glass-ceramic plate is adjusted in this way.

Figure 3:
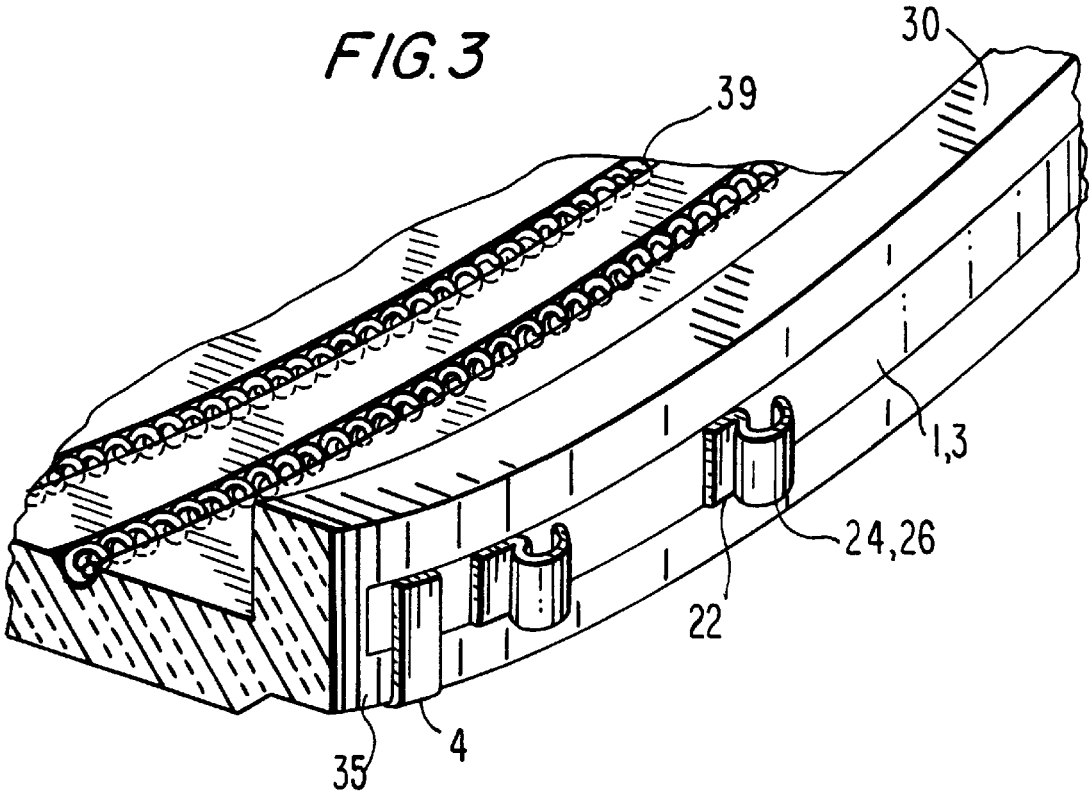
FIG. 3 is a cutaway perspective view of another embodiment of an mounted device according to the invention in a built-in state.

A mounting device is shown in FIG. 3, which has a circular receptacle support 1 in the form of a metal strip 3 similar to the embodiment shown in FIG. 1, however the strip 3 is arranged so that it is vertical in this embodiment instead of horizontal as in FIG. 1. Receptacles 20 for the fiber-optic light guides are formed by rolling-up or bending flaps formed or cut-out from the vertically arranged metal strip 3. It is also possible to put receptacles on the metal strip and fix them in place by means of point welding or hard-soldering as shown in FIG. 3. These receptacles 20 are also under tension so that the light guides are held in them by insertion of the light guide ends. The mounting device has small attaching straps 4 directed inward toward the heating element with which the mounting device is screwed onto the heating element housing 35. Furthermore the attaching straps 4 are each provided with a throughgoing hole, which must be matched with the holes on the underside of the heating element housing 35. The mounting can occur then by screw connection.

Only the sectioning apparatus for the metal strips need by adjusted according to the heating element diameter and/or circumference, which means that there is a high degree of flexibility.

Figure 4:
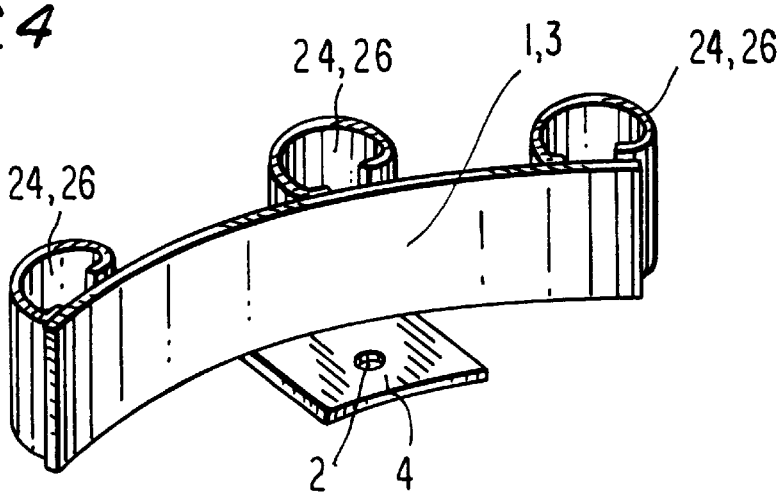
FIG. 4 is a cutaway perspective view of a further embodiment of a mounting device according to the invention.

A mounting device is shown in FIG. 4 which has only three receptacles 20 each in the form of a rolled-up strap 26. The receptacle support 1 is similarly a vertically oriented curved metal strip 3, on whose outer side the sleeves 24 are arranged equally spaced from each other. The receptacle support 1 is itself not formed as an attaching element and has a rectangular attaching strap 4 with a throughgoing hole 2 for attachment to the underside of the heating element housing. Preferably several of these mounting devices, e.g. four pieces, are attached to a heating element housing. This type of mounting device has the advantage that nearly all marketable radiant heating elements can be equipped with it and that comparatively much space is present for the different connecting straps and temperature protecting limiting elements between pairs of mounting devices. The light outlet positions of the light guide can thus be arranged into groups of 3×4, 4×4 or 4×5.

Figure 5A:
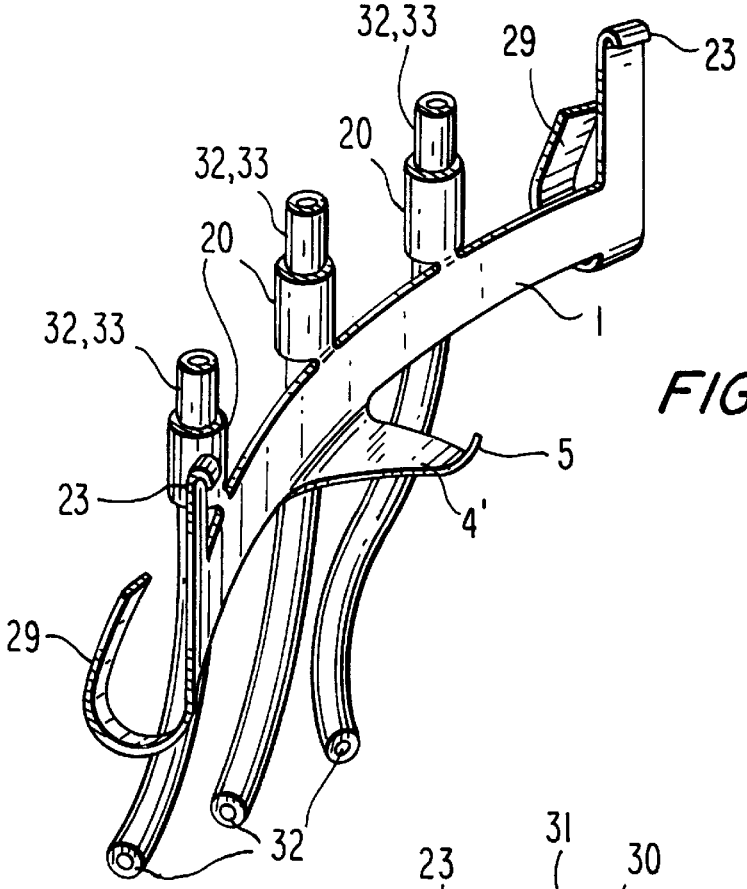
FIGS. 5*a* and 5*b* are respective cutaway perspective cross-sectional views of an additional embodiment of a mounting device according to the invention in a not built-in state and a built-in state.

An additional embodiment of the mounting device is shown in FIG. 5*a* in which only three receptacles 20 are arranged directly on receptacle support 1. The receptacle support 1 comprises a curved upright metal strip on whose upper edge the receptacles 20 are formed. An attaching strap 4' is attached on the lower edge of the receptacle support 1, and is pointed. It has an upwardly curved tip 5 at its free end. Furthermore upwardly extending strap-like extensions, which are formed as hooks 23, are provided at the opposite ends of the receptacle support 1. The hooks 23 point away inward, i.e. from the receptacles. Similarly additional straps are provided directed downward at the ends of the receptacle support 1, and are curved upward on the exterior of it to form retaining guides 29 for receiving the light guides 32. Thus the light guides 32 can be neatly installed. The receptacles 20 are each formed as a crimped socket in the embodiment shown here.

Figure 5B:
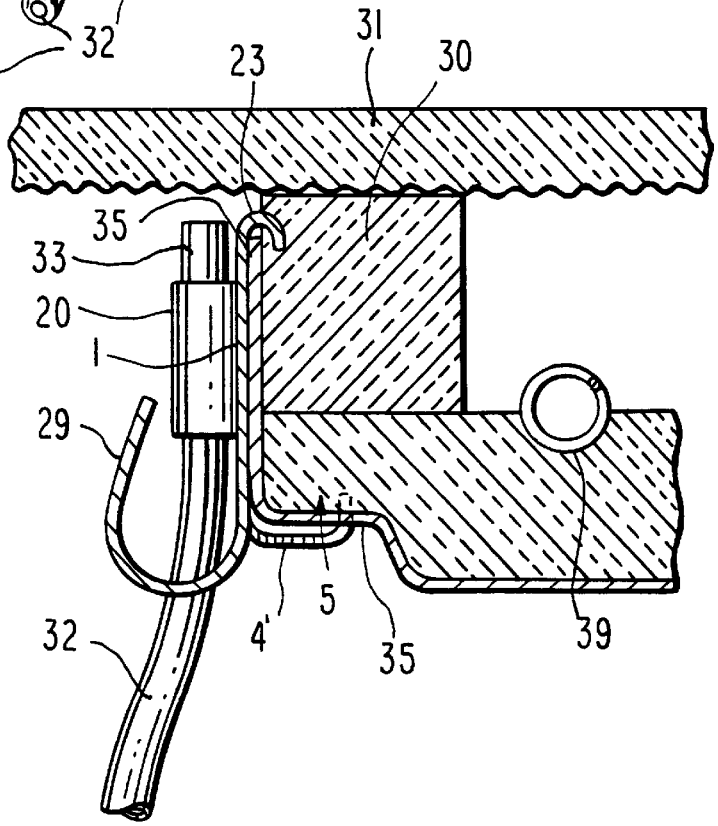

The embodiment of 5*a* is shown installed or built-in in FIG. 5*b*. The hooks 23 are suspended on upper edges of the heating element housing 35 and subsequently the claw-like attaching strap 4' is inserted with its tip 5 in the hole present in the heating element housing. In this embodiment the thickness of the sheet metal, preferably not roasted high-grade steel sheet, is selected sufficiently thin so that the hooks 23 make no contact with the underside of the glass-ceramic cooking surface 31.

Figure 6A:
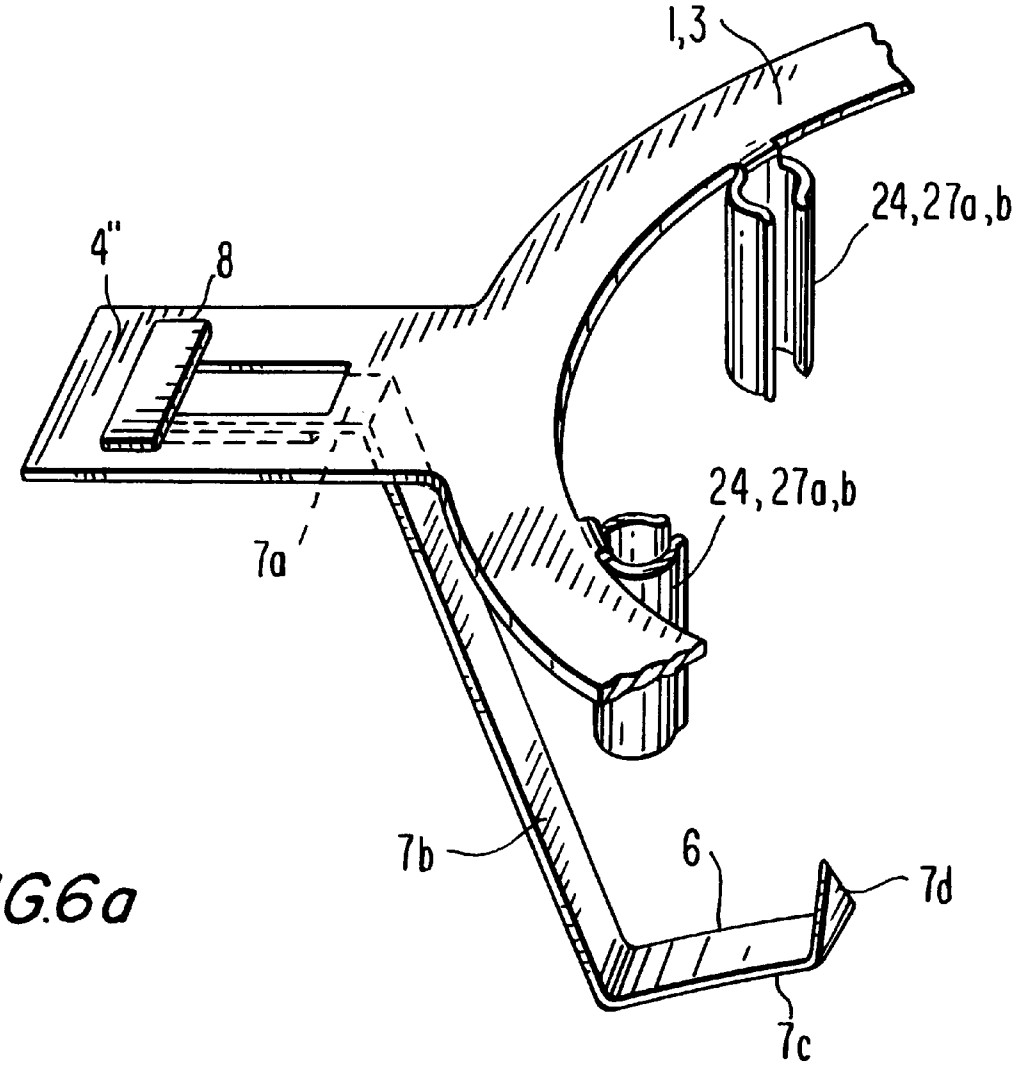
FIG. 6*a* is a cutaway perspective cross-sectional views of another embodiment of a mounting device according to the invention.

A part of a mounting device is shown in FIG. 6*a*, which has a receptacle support 1 in the form of a flat metal strip 3, on whose inner edge the sleeves 24 are arranged pointing downward. The sleeves 24 are each formed in this embodiment by two rolled-up straps 27*a* and 27*b*. An attaching strap 4' is formed on the outer edge of the receptacle support, which is neither attached directly to the underside of the glass-ceramic cooking surface or inserted in a mounting adapter to be described. This mounting device is formed in such a way that the heating element 39 with the heating element housing can be received by it. For this purpose additional spring elements are provided, of which one spring element 6 is shown. This spring element 6 has three sections 7*a*, 7*b* and 7*c* as well as a tip 7*d* at its free end. The section 7*a* is connected with attaching strap 4" and inserted there preferably in a suitable locking opening or recess. It is also possible to form the mounting means and the spring element 6 in one piece.

A downwardly pointed section 7*b* is connected to section 7*a*. The downwardly directed section 7*b* continues in a gently upwardly inclined section 7*c*. The tip 7*d* projects vertically upward from the end of the section 7*c*.

Figure 6B:
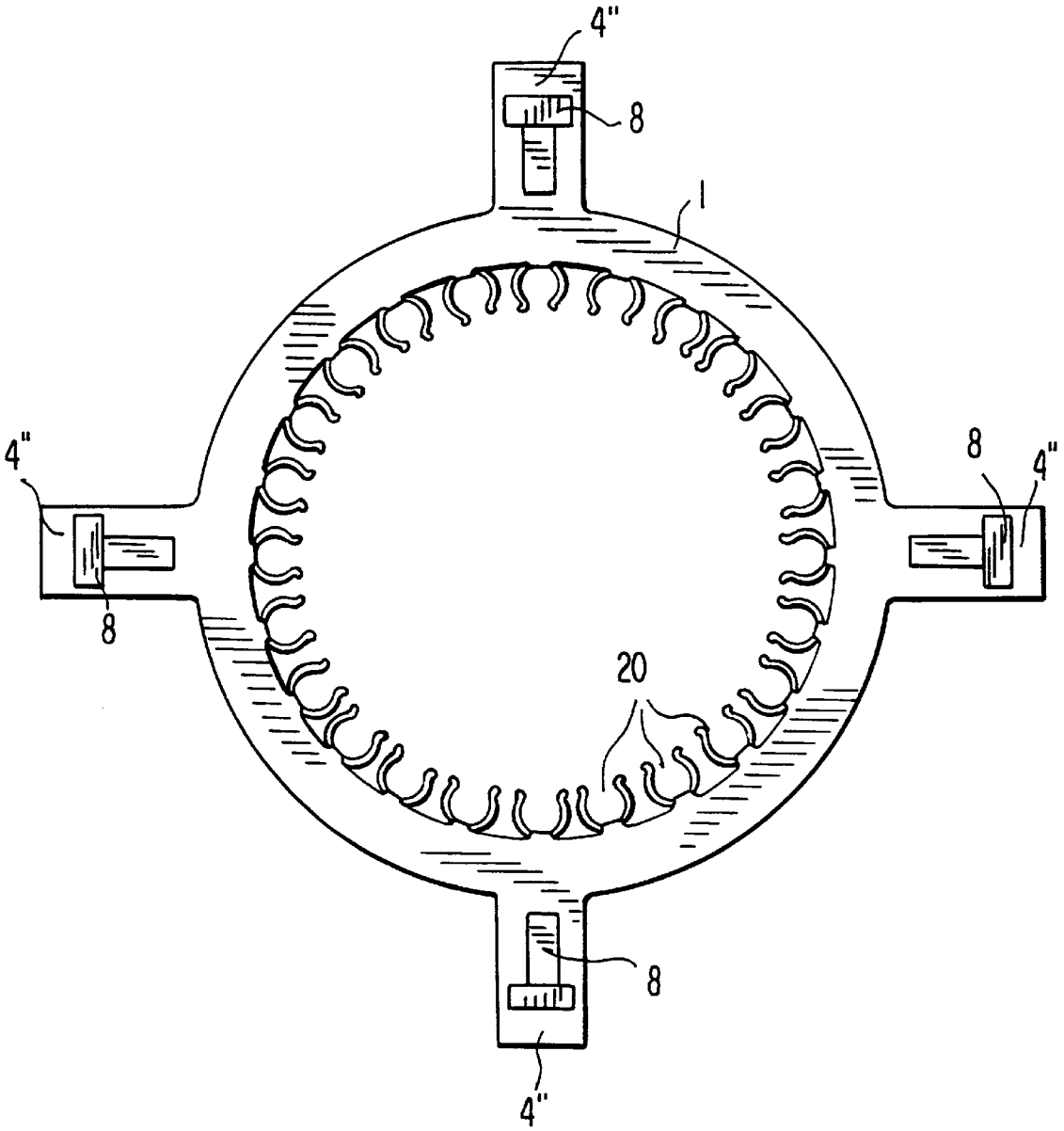
FIG. 6*b* is a cutaway plan view of the mounting device shown in FIG. 6*b;*
Figure 6C:
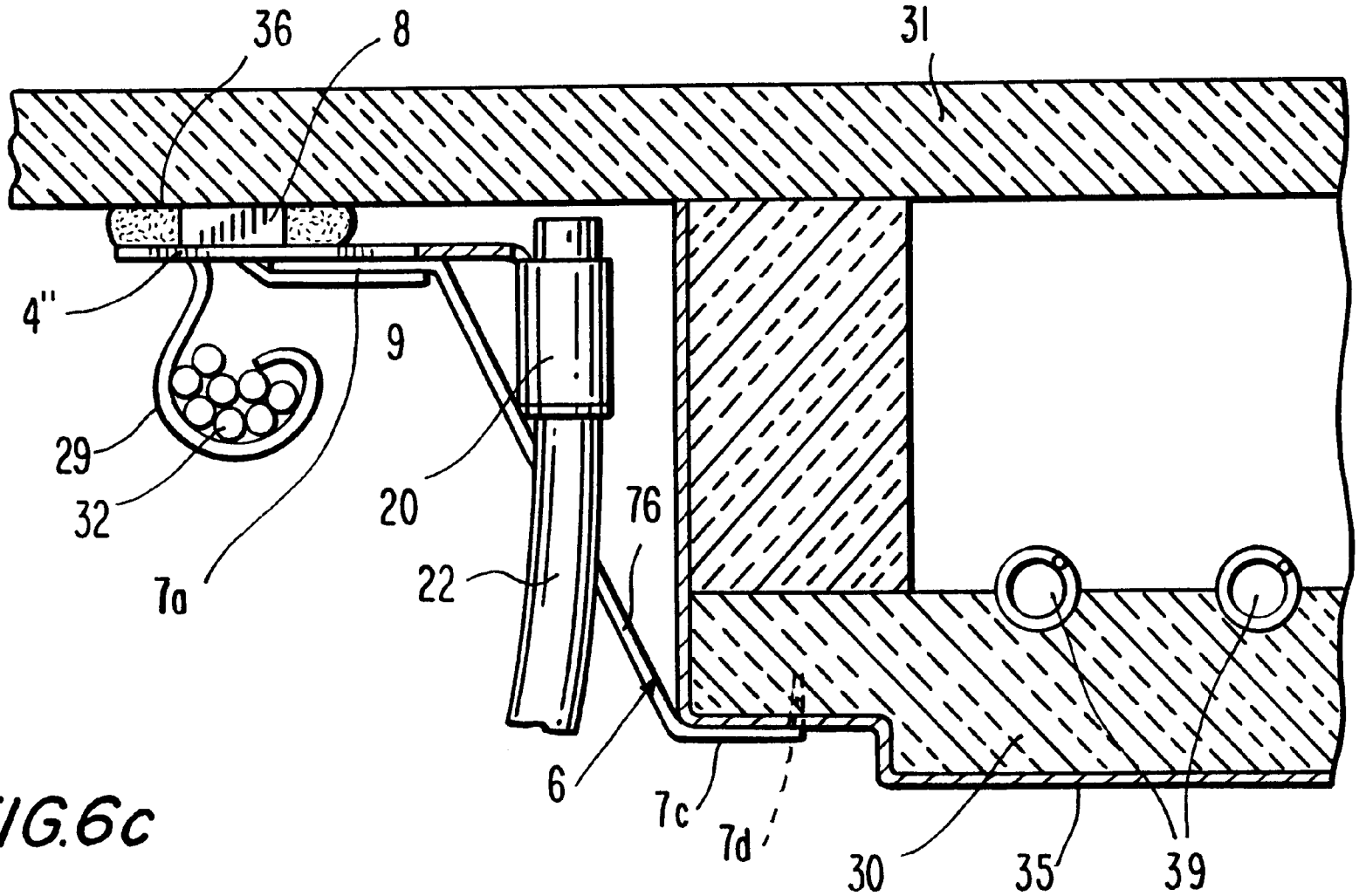
FIG. 6*c* is a view of the mounting device shown in FIGS. 6*a* and 6*b;*

A top plan view of the complete mounting device is shown in FIG. 6*b*. The receptacle support 1 is a closed ring on which four outwardly pointing attaching straps 4" are arranged. A plurality of receptacles 20 are arranged on the inner side of the receptacle support 1. Spacers 8 are arranged on the upper side of the attaching straps 4" whose significance can be seen particularly in FIG. 6*c*. The spacers 8 are arranged between the lower side or underside of the glass-ceramic plate 31 and the attaching straps 4". The attaching straps 4" are glued to the underside of the glass-ceramic plate 31 by means of an adhesive 36. Preferably a high temperature-resistant permanently elastic adhesive 36 is used. The spacer 8 guarantees a definite spacing of the light guide ends from the underside of the glass-ceramic plate 31 and prevents a direct metal/glass contact with the attaching strap 4". The spacer 8 comprise a double-sided, about 0.8 to 1 mm thick adhesive band. The adhesive on the attaching strap 4" should not be arranged as much as possible in the immediate vicinity of the heating element edge, since there temperatures reach up to 300° C. for a short time and from 200 to 250° C. for a comparatively longer time. Preferably adhesive straps thus are formed which provide adhesion at lower temperatures.

The spring element 8 is put on the underside of the attaching strap 4" with its section 7*a* resting on a catch plate 9 and engages the underside of the heating element housing 35 with its section 7*c*.

A retaining member 29 in which the light guide 32 is received is attached to the underside of the attaching strap 4".

Figure 7A:
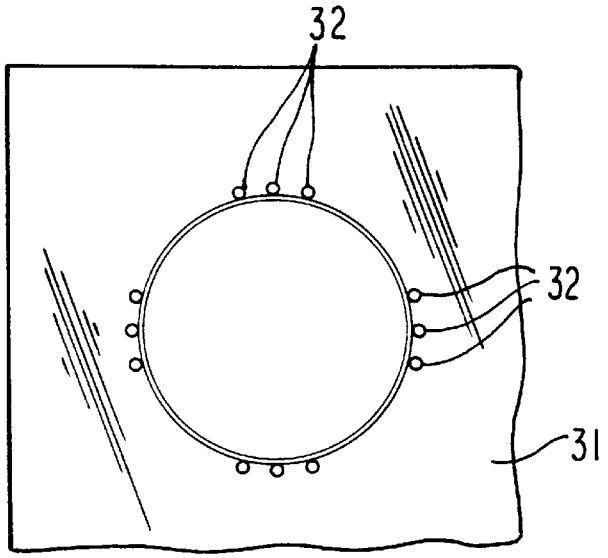
FIGS. 7*a* to 7*c* are diagrammatic plan views of different arrangements of light guides for marking a cooking field boundary.
Figure 7B:
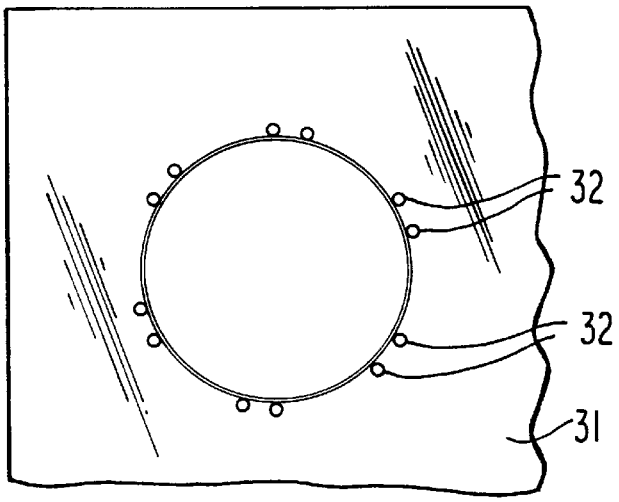
Figure 7C:
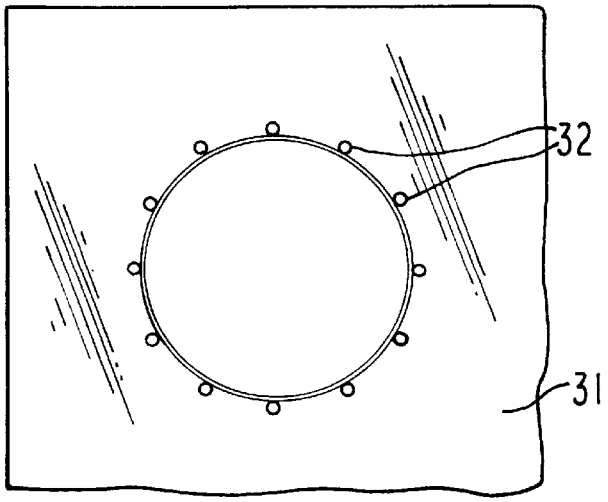

Different arrangements of the light guides on the edge of the cooking field are shown in FIGS. 7*a* to 7*c*. When the mounting device according to FIG. 6*b* is used, all receptacles 20 must not be equipped with light guides. Four groups with three light guides each are arranged at the border of the cooking field in FIG. 7*a*. Six groups with two light guides 32 each are arranged in a circle in FIG. 7*b* and the individual light guides are equally spaced in FIG. 7*c*.

Figure 8:
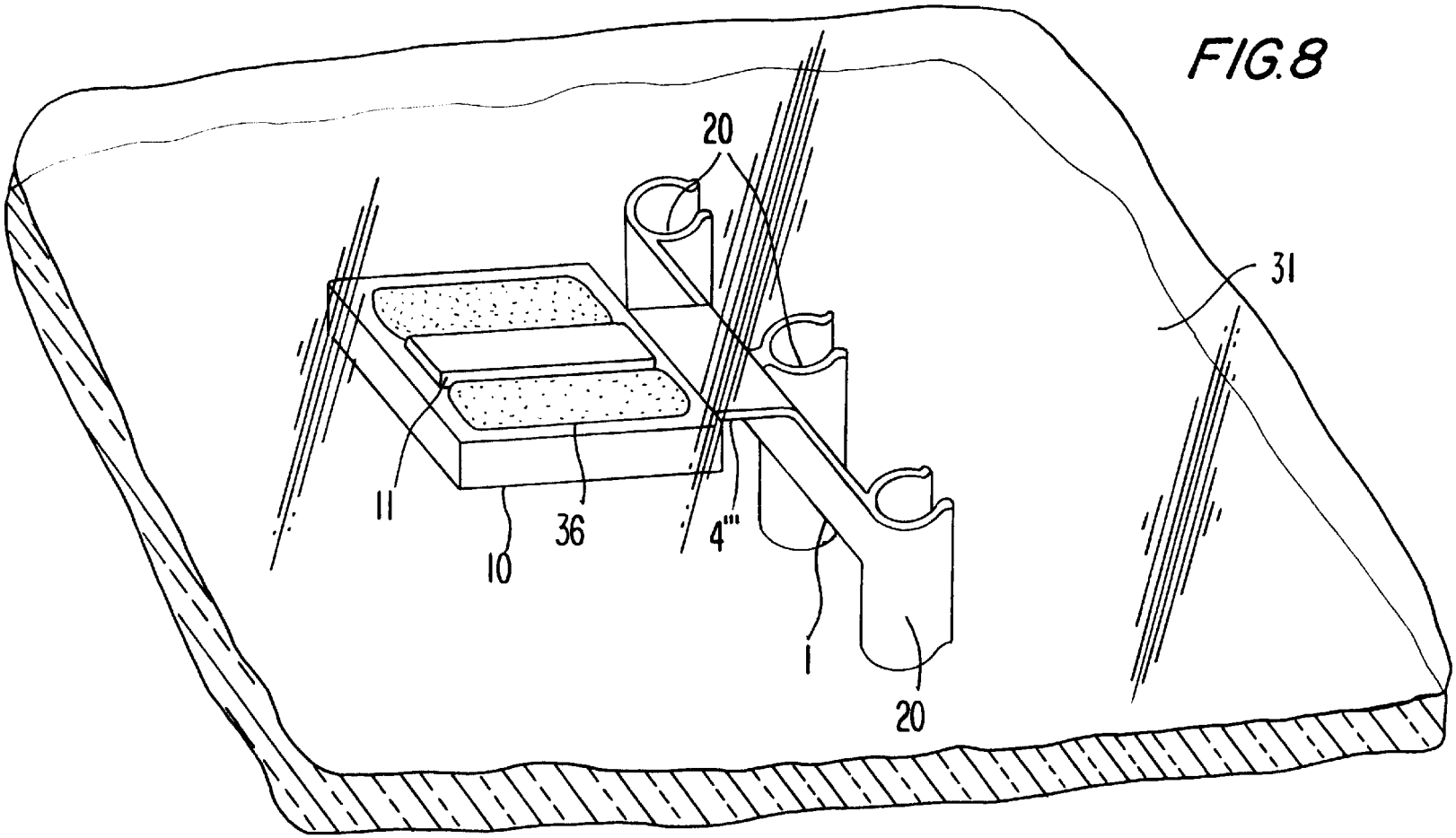
FIG. 8 is a perspective view of a mounting device according to an additional embodiment of the invention with a mounting adapter.

An additional embodiment is shown in FIG. 8, in which three receptacles 20 are arranged on the inner side of the upright receptacle support 1. An outwardly pointing attaching strap 4"' is arranged on the upper edge of the receptacle support 1, which is inserted in a mounting adapter 10. The mounting adapter 10 is, for example, glued by means of silicone glue to the glass-ceramic underside. Spacers 11 in the form of straps, knobs or the like are arranged on the upper side of the mounting adapter 10. The adhesive is indicated with the reference number 36. Preferably the attaching strap 4"' is lockable in the mounting adapter 10.

Figure 9:
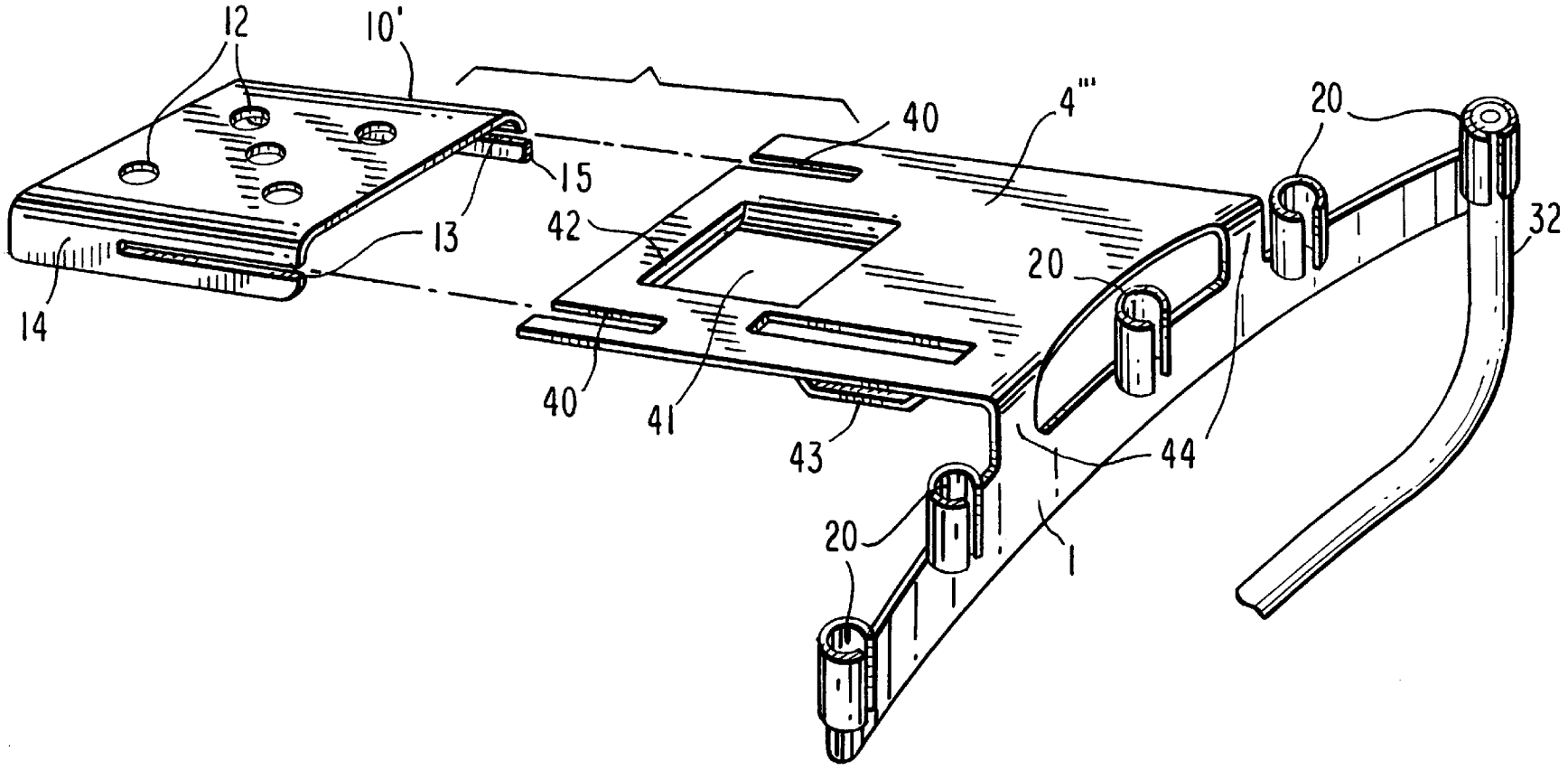
FIG. 9 is a perspective view of a mounting device according to a further embodiment of the invention with a mounting adapter.

An additional embodiment of the mounting adapter 10' which has a U-shaped form is shown in FIG. 9. Each of two opposing side members 14 and 15, which point downward, have a respective slot 13, which extends longitudinally therein. Throughgoing holes 12 are provided in it for passage of the adhesive.

The attaching strap 4"' is similarly provided with two slots 40, which cooperated with the slots 13 of the mounting adapter 10'. The length of the slots 13 and 40 is adjusted with respect to each other so that the attaching strap 4"' can be completely inserted in the mounting adapter 10'. A lock opening 42 is provided by forming a depressed portion of the attaching strap 4"' in which the spring element 6 is inserted. A retaining element or member 43 is arranged on the underside of the attaching strap 4"' for easy holding of the light guide or guides 32.

The attaching strap 4"' is connected by two webs 44 with the receptacle support 1 on whose upper edge the receptacles 20 are arranged. In contrast to the circular embodiment shown in FIGS. 6*a* to 6*d*, the receptacle support 1 according to FIG. 9 comprises a circular arc segment or section so that an arrangement can be formed from a plurality, advantageously four, mounting adapters 10 with receptacle supports 1 for each heating element. This has the advantage that standardized parts can be made and thus heating elements of different diameters can be equipped.

Figure 10:
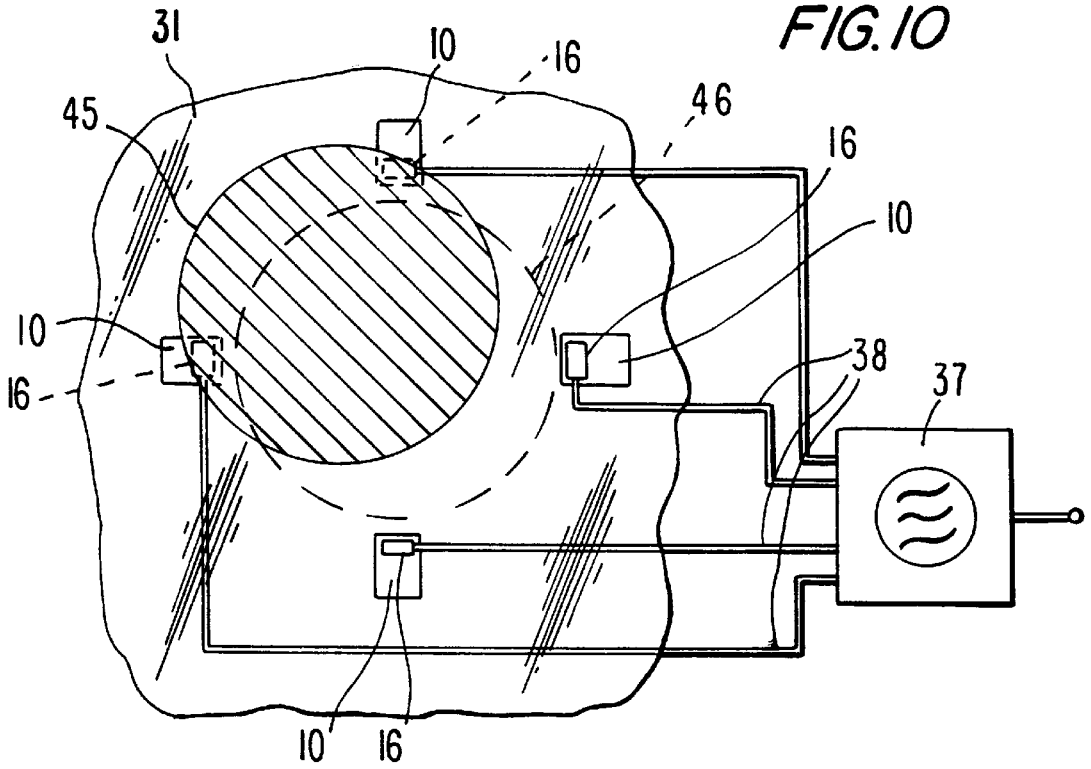
FIG. 10 is a plan view of an arrangement including a mounting adapter for use in a pot detection sensor.

FIG. 10 shows an arrangement of four mounting adapters 10 which are located around the heating element. The mounting adapters 10 are formed so that metal surfaces 16 electrically insulated from the heating element are mounted on the mounting adapter 10, which thus operate as a pot detecting sensor and thus form an additional application besides the mounting of the light guides and fixing of the heating elements. The metal surfaces 16 are connected with a high frequency generator 37 via connecting lines 38, which supplies a definite output signal, when, for example, a pot, which is shown by the shaded surface 45, is placed on the heated cooking zone 46 displaced with respect to the cooking zone 46.

Figure 11:
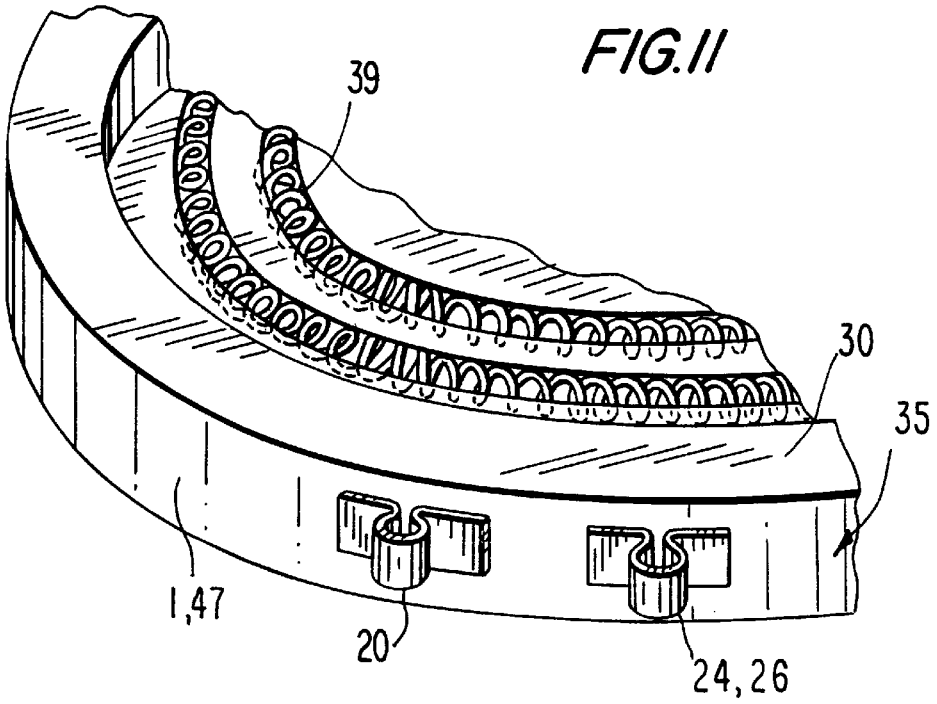
FIG. 11 is a perspective view of a mounting sleeve directly on the heating element housing.

An additional embodiment is shown in FIG. 11, in which a portion of the lateral wall 47 of the heating element housing 35 forms the receptacle support 1. The light guides are fixed in the crimped sockets roughed out from the side walls 47. Receptacles 20 can be placed on the receptacle support 1 and fixed there by means of point welding or hard-soldering as an additional possibility.

The disclosure in German Patent Application 196 51 859.8–34 of Dec. 13, 1996 is incorporated here by reference. This German Patent Application, at least in part, describes the invention described hereinabove and claimed in the claims appended hereininbelow and provides the basis for a claim of priority for the instant invention under 35 U.S.C. 119.

While the invention has been illustrated and described as embodied in a mounting device for a light guide operating as a cooking zone marking and/or residual heat indicator, it is not intended to be limited to the details shown, since various modifications and changes may be made without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention.

What is claimed is new and is set forth in the following appended claims:

We claim:

1. A mounting device for light guides operating as a cooking zone marking and/or residual heat indicator, said mounting device comprising a receptacle support (1) operating itself as a means for attaching or provided with at least one attaching element; and a plurality of receptacles (20) arranged beside each other on the receptacle support (1), each of said receptacles (20) including means for receiving an end portion of a light guide;

wherein the receptacles (20) each comprise a sleeve (24) under pre-tension in which the end portion of one of the light guides are inserted or the receptacles each comprise a crimped socket in which the end portion of one of the light guides is inserted and gripped under tension.

2. The mounting device as defined in claim 1, wherein the receptacle support (1) comprises a metal strip (3) on which said sleeves (24) are provided as integral parts of the metal strip (3).

3. The mounting device as defined in claim 1, wherein the receptacle support (1) comprises a ring or a ring segment.

4. The mounting device as defined in claim 1, wherein each of the sleeves (24) comprises at least one rolled-up strap (26, 27*a,b*).

5. The mounting device as defined in claim 1, wherein each of the sleeves (24) has a truncated cone shape.

6. The mounting device as defined in claim 1, wherein each of said sleeves (24) is directly attached to the receptacle support (1) or is attached by a retaining element (22) with the receptacle support (1).

7. The mounting element as defined in claim 1, wherein the receptacle support (1) is provided with at least one attaching strap (4, 4', 4", 4"') extending from the receptacle support (1).

8. The mounting element as defined in claim 7, wherein the receptacle support (1) is provided with hooks (23) for attachment and/or retaining members (29) for holding the light guides.

9. The mounting element as defined in claim 7, wherein the at least one attaching strap (4') has a free end and an upwardly curved tip (5) at said free end.

10. The mounting element as defined in claim 7, further comprising at least one spring element (6) arranged on the at least one attaching strap (4").

11. The mounting element as defined in claim 7, wherein the receptacle support (1) is provided with said at least one attaching element as a separate component and the at least one attaching element is a mounting adapter (10) in which the at least one attaching strap (4"') is inserted.

12. The mounting element as defined in claim 11, wherein the mounting adapter (10,10') has a U-shape and includes two side members (14,15) and each of said side members is provided with a longitudinal slot (13) for insertion of said at least one attaching strap (4"').

13. The mounting element as defined in claim 11, wherein the mounting adapter (10,10') is provided with an electrically insulated metal surface (16).

14. The mounting element as defined in claim 11, further comprising at least one spacer (11) provided on an upper surface of the mounting adapter (10,10').

15. The mounting element as defined in claim 1, wherein the receptacle support (1) comprises a portion of a side wall (47) of a heating element housing (35).

16. The mounting element as defined in claim 1, wherein the receptacles formed as said sleeves(24) or said crimped sockets are stamped or punched out of said receptacle support (1).

17. The mounting element as defined in claim 1, wherein the receptacles formed as said sleeves (24) or said crimped sockets are attached to the receptacle support (1) by means of a point-weld or by hard-solder.

18. The mounting element as defined in claim 1, wherein the receptacle support (1) with the receptacles (20) is screwed on a retaining frame or on the cooking surface.

19. The mounting element as defined in claim 1, wherein the receptacle support (1) with the receptacles (20) is lockable with a retaining frame or with a cooking surface.

* * * * *